US009728845B2

(12) United States Patent
Iellici

(10) Patent No.: US 9,728,845 B2
(45) Date of Patent: Aug. 8, 2017

(54) DUAL ANTENNA STRUCTURE HAVING CIRCULAR POLARISATION CHARACTERISTICS

(75) Inventor: Devis Iellici, Cambridge (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 13/979,433

(22) PCT Filed: Jan. 13, 2012

(86) PCT No.: PCT/GB2012/050071
§ 371 (c)(1),
(2), (4) Date: Sep. 13, 2013

(87) PCT Pub. No.: WO2012/095673
PCT Pub. Date: Jul. 19, 2012

(65) Prior Publication Data

US 2014/0009343 A1 Jan. 9, 2014

(30) Foreign Application Priority Data

Jan. 14, 2011 (GB) ..... 1100617.8

(51) Int. Cl.
*H01Q 1/36* (2006.01)
*H01Q 1/38* (2006.01)
(Continued)

(52) U.S. Cl.
CPC ..... *H01Q 1/36* (2013.01); *H01Q 1/38* (2013.01); *H01Q 9/0428* (2013.01); *H01Q 9/42* (2013.01);
(Continued)

(58) Field of Classification Search
CPC ..... H01Q 1/38; H01Q 1/48
(Continued)

(56) References Cited

U.S. PATENT DOCUMENTS 5,966,097 A 10/1999 Fukasawa et al.
6,028,563 A * 2/2000 Higgins ..... H01Q 1/246 343/797
(Continued)

FOREIGN PATENT DOCUMENTS

EP 1315238 A2 5/2003
EP 1315238 B1 8/2006
(Continued)

OTHER PUBLICATIONS

International Searching Authority; U.S. Patent and Trademark Office; International Search Report for PCT/US2013/021611, dated Jun. 10, 2013, 3 pages.
(Continued)

*Primary Examiner* — Dameon E Levi
*Assistant Examiner* — Walter Davis
(74) *Attorney, Agent, or Firm* — Holzer Patel Drennan

(57) ABSTRACT

There is disclosed an antenna device made up of at least first, second and third conductive metal plates arranged in a parallelepiped configuration. The third plate defines a lower plane and the first and second plates together define an upper plane substantially parallel to the lower plane. The first and second plates are separated by a slot in the upper plane, and the second and third plates are connected to each other by a grounding connection. The first plate comprises a first, active antenna arm that is provided with a feed connection, and the second plate comprises a second antenna arm that may be passive or active. The antenna device generates a circularly polarized radiation pattern that is good for personal navigation devices, while being significantly more compact than existing ceramic patch antennas that are typically used in these devices.

22 Claims, 11 Drawing Sheets

(51) Int. Cl.
*H01Q 9/42* (2006.01)
*H01Q 21/24* (2006.01)
*H01Q 9/04* (2006.01)

(52) U.S. Cl.
CPC ..... *H01Q 21/24* (2013.01); *Y10T 29/49016* (2015.01)

(58) Field of Classification Search
USPC ..... 343/700 MS; 342/357.12
See application file for complete search history.

(56) References Cited

U.S. PATENT DOCUMENTS

| | | | | |
|---|---|---|---|---|
| 6,300,909 | B1 | 10/2001 | Tsubaki et al. | |
| 6,339,402 | B1 | 1/2002 | McKivergan | |
| 6,373,446 | B2 * | 4/2002 | Apostolos | H01Q 1/36 343/700 MS |
| 6,680,705 | B2 * | 1/2004 | Tan | H01Q 9/0421 343/700 MS |
| 6,888,510 | B2 * | 5/2005 | Jo | H01Q 21/26 343/700 MS |
| 7,123,209 | B1 | 10/2006 | Desclos et al. | |
| 7,623,075 | B2 * | 11/2009 | Apostolos | H01Q 1/3275 343/700 MS |
| 7,705,786 | B2 * | 4/2010 | Iellici | H01Q 1/243 343/700 MS |
| 2003/0098813 | A1 * | 5/2003 | Koskiniemi | H01Q 9/0421 343/702 |
| 2003/0146874 | A1 | 8/2003 | Kane | |
| 2003/0189525 | A1 | 10/2003 | Tan et al. | |
| 2004/0113845 | A1 * | 6/2004 | Mikkola | H01Q 1/243 343/700 MS |
| 2004/0125032 | A1 * | 7/2004 | Ikuta | H01Q 1/12 343/702 |
| 2005/0057401 | A1 * | 3/2005 | Yuanzhu | 343/700 MS |
| 2005/0078039 | A1 | 4/2005 | Harano | |
| 2007/0120745 | A1 | 5/2007 | Qi et al. | |
| 2007/0171131 | A1 | 7/2007 | Sorvala et al. | |
| 2008/0158088 | A1 | 7/2008 | Mai et al. | |
| 2009/0002229 | A1 * | 1/2009 | Noro | H01Q 9/0407 342/357.64 |
| 2009/0213014 | A1 * | 8/2009 | Iellici | H01Q 5/378 343/700 MS |
| 2011/0221644 | A1 * | 9/2011 | Lee | H01Q 9/0421 343/770 |

FOREIGN PATENT DOCUMENTS

| | | | |
|---|---|---|---|
| EP | 2091103 | A1 | 8/2009 |
| GB | 2450786 | B | 1/2009 |
| JP | 2001196828 | A | 7/2001 |
| JP | 2001358515 | A | 12/2001 |
| JP | 2003318638 | A | 11/2003 |
| JP | 2006527949 | A | 12/2006 |
| JP | 2009218917 | A | 9/2009 |
| JP | 2010109434 | A | 5/2010 |

OTHER PUBLICATIONS

International Searching Authority, U.S. Patent and Trademark Office; Written Opinion for PCT/US2013021611, dated Jun. 10, 2013, 5 pages.
H.K. Kan, et al, "Small dual L-shaped printed antenna," Electronic Letters Nov. 13, 2003, (vol. 39; Issue 23), 2 pages.
Office Action received in Chinese Patent Application No. 201280005286.1, filed Jan. 13, 2012, Office Action issued Jul. 30, 2014, 4 pages.
Search Report received in the Office Action of Chinese Patent Application No. 201280005286.01, filed Jan. 13, 2012, Search Report dated Jul. 17, 2014, 2 pages.
Third Office Action received in Chinese Patent Application No. 20120005286.1 (PCT/GB2012/050071); Mailed Date: Oct. 19, 2015, 11 pages.
"Office Action Received in Russia Patent Application No. 2013132436", Mailed Date: Oct. 18, 2013, Filed Date: Jan. 13, 2012, 3 Pages. (W/O English Translation).
"Office Action Received in Russia Patent Application No. 2013132436", Mailed Date: Dec. 20, 2013, Filed Date: Jan. 13, 2012, 4 Pages.
"Second Office Action Issued in Chinese Patent Application No. 201280005286.1", Mailed Date: Apr. 8, 2015, 11 Pages.
"Office Action Issued in Russian Patent Application No. 2013132436", Mailed Date: Nov. 19, 2015, 6 Pages. (W/o English Translation).
"Office Action Issued in Japanese Patent Application No. 2013-548892", Mailed Date: Dec. 22, 2015, 3 Pages. (W/o English Translation).
"Office Action & Search Report Issued in Taiwan Patent Application No. 101101363", Mailed Date: Mar. 28, 2016, 7 Pages.
"Office Action Issued in Russian Patent Application No. 2013132436", Mailed Date: May 19, 2016, 5 Pages.
"Office Action Issued in Taiwanese Patent Application No. 101101363", Mailed Date: Oct. 12, 2016, 2 Pages.

* cited by examiner

DUAL ANTENNA STRUCTURE HAVING CIRCULAR POLARISATION CHARACTERISTICS

This application is a 35 U.S.C. §371 National Stage entry of, and claims the benefit of priority to International Application No. PCT/GB2012/050071, filed on Jan. 13, 2012, which is hereby incorporated by reference in its entirety as if fully set forth herein, and also claims benefit of foreign priority to Great Britain Application No. 1100617.8, filed Jan. 14, 2011.

Embodiments of the present invention relate to an antenna structure comprising an active arm and a passive arm, the arms being disposed in such a way as to create a circularly polarised radiation pattern that is good for personal navigation devices (PNDs), automotive Global Positioning System (GPS) receiver applications, GPS-enabled cameras and the like. In particular, but not exclusively, embodiments of the present invention provide a substantially thinner GPS radio antenna solution than conventional ceramic patch antennas, when used in the above devices, thereby enabling thinner consumer products to be designed.

BACKGROUND

Many existing navigation and other GPS-enabled devices use a ceramic patch antenna connected to a GPS receiver. This is because ceramic patch antennas offer several advantages. Firstly, provided that the ceramic patch is not too small, good right-hand circular polarization (RHCP) can be obtained. GPS radio signals are transmitted using RHCP. Generally, ceramic patch antennas larger than about 15 mm×15 mm×4 mm provide good RHCP reception. Also, the radiation pattern of a horizontally mounted ceramic patch antenna gives good coverage of the upper hemisphere when the patch is mounted horizontally at the top of a device and facing the sky. Circular polarization is also used in many other telecommunication systems, such as SDARS and DVB-SH.

Unfortunately, ceramic patch antennas also suffer from significant drawbacks. When the patch is made smaller and more commensurate with the requirements of modern consumer devices (patch sizes typically 12 mm×12 mm×4 mm or less) most of the advantages are lost. The RHCP characteristic is reduced and the polarization becomes more linear unless a large ground plane is placed under the antenna, which is not practical in a mobile or hand-held device. Also the efficiency is reduced and the radiation pattern becomes more omnidirectional, with less gain toward the sky. Furthermore, the bandwidth of the antenna becomes very narrow, making manufacturing tolerances critical and increasing the cost.

In general, ceramic patch antennas have a very high Q and cannot be fine-tuned using external matching circuits. The high Q implies a narrow bandwidth and this in turn means that in different applications the same antenna requires tuning in order to be on frequency. Because matching circuits cannot be used, the ceramic patch has to be physically changed to tune it for a specific design. This requirement for physically changing the antenna increases the cost and the length of the integration process for every new application. Essentially, a new ceramic patch design must be created for each application.

Perhaps the greatest disadvantage of the ceramic patch antenna is the severe constraint it places upon the minimum thickness of a GPS-enabled device, as the thickness must be at least 12 mm to accommodate the ceramic patch. In a typical application, such as a navigation device in a car, there is a vertically mounted flat-screen display and potentially the device could be made quite thin were it not for the need to encompass the width of the ceramic patch. Finally, ceramic patches are expensive to manufacture compared to many other types of small antenna.

FIG. 1*a* shows a typical GPS-enabled consumer device comprising an LCD display 1, a main PCB 2, a groundplane 3 and a ceramic patch antenna 4. FIG. 1*b* shows how the minimum device thickness is dictated by the antenna 4, which is mounted horizontally on top of the vertical PCB 2.

Although other types of antenna are available that can solve some the above issues, none really match the performance of a large patch for GPS applications and so where optimal performance is required, large patches continue to be used and consumer devices are made thick enough to encompass the patch.

An example of a known antenna is disclosed in US2008/0158088, in the form of a class of thin antenna for GPS applications. However, such antennas are linearly polarized (see paragraph [0009]), and therefore not comparable with modern ceramic patch antennas. A further drawback of the antennas disclosed in US2008/0158088 is that in order to feed the antenna it is necessary to solder a coaxial cable directly to the antenna structure, and the antenna cannot be fed directly by the host PCB. This also means that there is no provision for a matching circuit, so the antenna must be self-resonant at the desired frequency, and the physical structure of the antenna must be changed in order to adjust the antenna to any particular host device.

Another example of a known antenna is disclosed in US2007/0171130. Although the superficially similar to some embodiments of the present invention, there are important differences. First of all the problem to be solved is very different, as US2007/0171130 teaches how to design an elongated multi-band antenna with broadband function for cellular communications, and no importance is given to the circular polarization properties of the waves generated by the antenna and the shape of the radiation pattern, which are important for satellite communications. Furthermore, the structure defined in US2007/0171130 requires a connection using coaxial cable soldered directly to the antenna, and therefore it suffers from the same drawbacks discussed above for US2008/0158088.

A further antenna is known from EP0942488A2. In this case the antenna can generate a circular polarized wave; however, because the two arms forming the antenna are arranged in perpendicular directions, such type of antenna is not suitable for application in thin devices. The same consideration applies to the antenna type disclosed in US2008/0284661.

US20055/0057401 discloses an antenna comprising an active arm and a passive arm that are mounted over a groundplane with a slot between the two arms. However, the groundplane is much larger in area than the area under the active and passive arms, and the arms are all fed and grounded at the same end of the antenna device. This antenna is not stated to have any circular polarization properties, nor can it be formed from a single sheet of metal.

The problem to be solved is thus to create a low-cost antenna that occupies a small space, can fit inside thin flat-screen devices, requires little or no customisation when installed on many different types of platform and yet will give the performance of a ceramic patch antenna.

BRIEF SUMMARY OF THE DISCLOSURE

According to a first aspect of the present invention, there is provided an antenna device comprising at least first, second and third conductive metal plates arranged in a substantially parallelepiped configuration, with the third plate defining a lower plane and the first and second plates together defining an upper plane substantially parallel to the lower plane, wherein: the first and second plates are substantially similar in shape and are of substantially the same length as each other along a major axis of the antenna; the first and second plates are separated by a slot in the upper plane, the slot extending along the major axis of the antenna and having a length similar to the length of each of the first and second plates; the first plate comprises an active antenna arm that is provided with a feed connection; the second plate comprises either a passive antenna arm that is provided with a grounding connection to the third plate, or a second active antenna arm that is provided with a grounding connection to the third plate and also with a feed connection; and wherein the feed or grounding connections are not all formed on a single side of the parallelepiped arrangement of plates.

The feed connection of the active antenna arm preferably extends substantially perpendicular to the third plate and passes through a slot or hole provided in the third plate.

The feed connection may be formed as an integral feed pin which extends through and beyond the third plate. This is an important feature of certain embodiments, as it allows the direct connection of the antenna to a host device without the use of expensive coaxial cables. Moreover, in this way the antenna can be connected to a matching circuit, which can be used to adjust the resonant frequency of the antenna without the need of modifying the physical structure of the antenna. This feature makes it possible to use of the same antenna on many different devices without expensive customization.

In order to achieve circular polarization behaviour, the length of the slot in the upper plane between the first and second plates must be similar to the length of the first and second plates themselves, although the exact shape of the slot is not currently believed to be a critical feature for some embodiments. The special feature that the feed or grounding connections are not all formed on a single side of the parallelepiped arrangement of plates helps to promote circular polarization.

In preferred embodiments, the first, second and third plates are made from a flat sheet of metal by cutting and bending. In particular, the third plate and at least one or other, and in some cases both, of the first and second plates, may be formed from a single sheet of metal that is appropriately cut and then bent into shape. The feed connection may be made from the same metal sheet.

Embodiments of the present invention are to be distinguished from antennas that are formed by way of printed conductive tracks. In particular, the plates of embodiments of the antennas of the present invention may comprise relatively stiff metal structures which retain their own shape without the need for an underlying substrate.

In alternative embodiments, antenna devices of the present invention may be manufactured using a flexible printed circuit wrapped around a non-conductive mechanical support, or by using a Laser Direct Structuring (LDS) process, where the shape of the conductive part of the antenna device is imprinted on a plastic or dielectric support using a laser, followed by plating the support in such a way that only the parts of the support that have been activated by the laser are metallized. Alternatively, the plates may be formed by etching a metal layer formed on or bound to a non-conductive support.

Preferred embodiments have a rectangular parallelepiped shape with typical dimensions 25 mm×5 mm×4 mm or less for the GPS frequency band, allowing a significant reduction of the total thickness of a consumer device from around 12 mm to 5 mm or less.

The antenna works optimally in the same position as a ceramic patch at the top of a device, facing the sky. The antenna can be fine tuned to the correct frequency using a simple external matching circuit, allowing the same antenna to be used in many different designs without mechanical changes.

Importantly, for GPS applications, the antenna is almost purely circularly polarized (RHCP or LHCP) when used in isolation (not connected to a big ground plane). Circular polarization is created by the combination of the electromagnetic field radiated by the slot between the first and second plates, and the electromagnetic field radiated by the radio-frequency current circulating around the loop-like path formed by the three plates together. Furthermore, the circular polarisation characteristic is maintained to a good degree when the antenna is connected to a large ground plane, for instance at the top of different application device PCBs or on top of LCD displays. When located in this way, similar to the way a ceramic patch antenna is disposed, the antenna generates a hemispherical radiation pattern similar to that of a patch antenna, which is suitable for some applications such the reception of GPS signals.

The antenna has significant cost advantages over ceramic patches because it may be manufactured from a single metal sheet, thereby considerably reducing the manufacturing cost.

In a first embodiment of the present invention, an antenna is constructed from a single flat piece of metal by cutting and bending. The lower plate is grounded and two upper plates or arms are provided with grounding connections to the lower plate, the grounding connections being at opposed ends of the lower plate. One upper arm is active and driven by a feeding pin, located in between the opposed ends of the antenna device, in a manner reminiscent of the way a planar inverted F antenna is fed with the grounding connection at one end. The other arm is passive and has only the ground connection.

In a second embodiment of the present invention, an antenna is constructed from a single flat piece of metal by cutting and bending. A lower plate is grounded and two upper plates or arms are provided with grounding connections to the lower plate. One upper arm is active and driven by a feeding pin at one end and grounded by a grounding connection to the lower plate along a long edge of the lower plate in between the two ends of the lower plate. The feeding and grounding arrangements are reversed with respect to the first embodiment. The other arm is passive and has only the ground connection at an end of the lower plate opposed to the end where the feeding pin of the active upper arm is located.

In a third embodiment of the present invention, an antenna is constructed from two separate flat pieces of metal by cutting and bending. The active arm is driven by a feeding pin at one end and no provision is made for grounding. A separate lower plate is grounded and supports a second, passive arm that has a grounding connection to the lower plate at an end opposed to the end where the feeding pin of the active arm is located. Because the antenna is manufactured from two separate metal pieces the structure is not wholly self-supporting and there is need of a non-conducting or dielectric mechanical supporting mechanism. This support may take the form of a block of non-conducting or dielectric mechanical, or pillars or even a plastic 'carrier' that clips, or is screwed, to the PCB and which holds one or more of the metal arms in place. Various other mechanical arrangements may be made to support the two arms.

In a fourth embodiment, both arms are fed and both are grounded. The second arm is fed with a signal out of phase with respect to the first arm as a form a differential feeding. The concept of having two PIFAs with a slot between them and feeding both with a phase difference is already known from Kan et al. [H. K. Kan, D. Pavlickovski and R. B. Waterhouse, "Small dual L-shaped printed antenna", ELECTRONICS LETTERS, Vol. 39, No. 23, 13 Nov. 2003]. However, Kan et al. describe a printed PIFA and they do not teach having a lower grounded plate to connect the two structures together. It will be appreciated that the differential feeding of both arms may be applied to the first three embodiments and also to the additional case where one arm is grounded and the other is not. It will also be appreciated that in all these embodiments, one feed may be connected to the radio and the other grounded as an alternative to differential feeding.

Moreover, with two feeding points, it is also possible to generate RHCP when using one feed and to generate LHCP when using the other feed.

It will also be appreciated that both, or either, arms may be provided with a matching circuit in all the embodiments above.

In the embodiments outlined above, the antenna has been described as a stand-alone component separate from the radio. However, the presence of the bottom ground plate allows the possibility of attaching a small PCB mounted with the components required for a RF front end (Low Noise Amplifier plus a Surface Acoustic Wave filter) or a complete radio receiver. In this way, an active antenna or complete radio-antenna module is created. The input to the LNA or radio receiver may be connected to the feed of the antenna and the ground of the LNA or radio may be connected to the bottom ground plate of the antenna. The output of the radio/LNA may be connected to the host PCB using a commercially available connector, coaxial cable or via soldering pins.

In another embodiment, the stamping, cutting and bending process used to create the antenna from a sheet of metal may also be used to create a screened volume beneath the ground or third plate suitable for locating the radio. The radio-antenna module is thus created with an integral screening can for the radio.

The third plate may be provided with one or more conductive tabs to facilitate connection of the antenna device to a host device. The one or more conductive tabs may be disposed in a coplanar configuration with the feed connection.

BRIEF DESCRIPTION OF THE DRAWINGS

For a better understanding of the present invention and to show how it may be carried info effect, reference shall now be made by way of example to the accompanying drawings, in which.

DETAILED DESCRIPTION

Figure 1A:
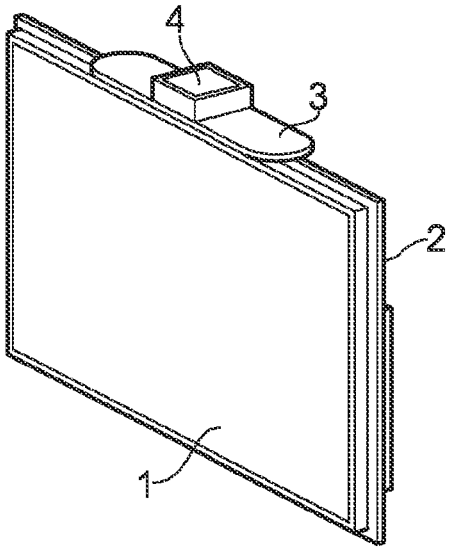
FIGS. 1*a* and 1*b* show a prior art ceramic patch enabled GPS receiving device.
Figure 1B:
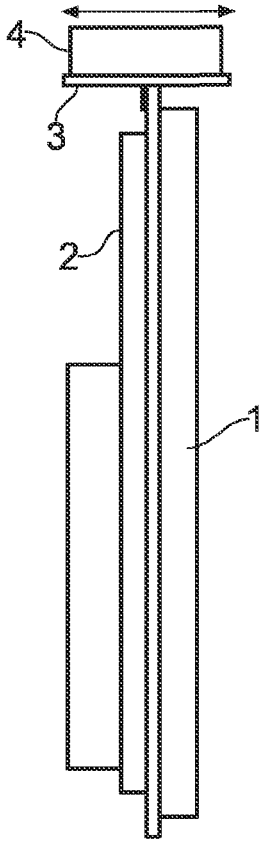
Figure 2:
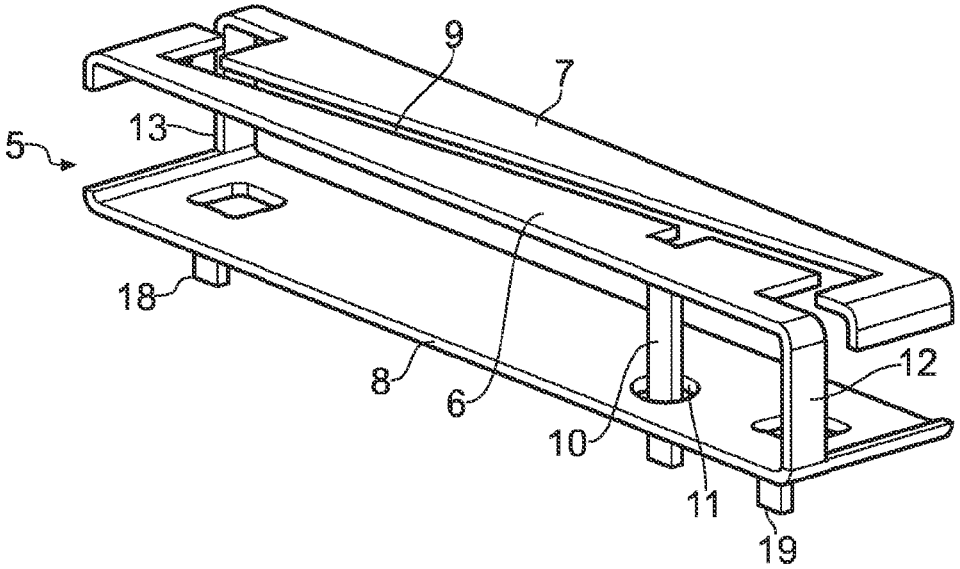
FIG. 2 shows a first embodiment of the present invention.

FIG. 2 shows a first embodiment of the present invention, comprising an antenna device 5 consisting of first 6, second 7 and third 8 conductive metal plates arranged in a substantially parallelepiped configuration. The third plate 8 defines a lower plane and the first 6 and second 7 plates together define an upper plane substantially parallel to the lower plane. The first 6 and second 7 plates are separated by a slot 9 in the upper plane.

The first plate 6 comprises an active antenna arm that is provided with a feed connection or pin 10 that passes through a hole 11 provided in the third plate 8. The first plate 6 also has a grounding connection or pin 12 that connects to the third plate 8.

The second plate 7 comprises a passive antenna arm that is provided with a ground connection or pin 13 that connects to the third plate 8 at an opposite end thereof to the ground connection or pin 12 of the first plate 6.

It can be seen that the overall envelope of the antenna device 5 is that of a rectangular parallelepiped, with the area of the first and second plates 6, 7 and their intermediate slot 9 being substantially the same in size and shape as the area of the third plate 8, and substantially parallel thereto.

Tabs 18, 19 are created in the third plate 8 so as to allow the antenna device 5 to be soldered along the edge of a host PCB (not shown). The tabs 18, 19 provide both a mechanical support and a ground connection. The tabs 18, 19 are preferably disposed in the same plane as the feed connection or pin 10 so that soldering can be done on a single side of the host device. Alternatively, tabs 18, 19 and the feed 10 can be arranged so that they are connected to different sides of the host PCB.

Figure 3:
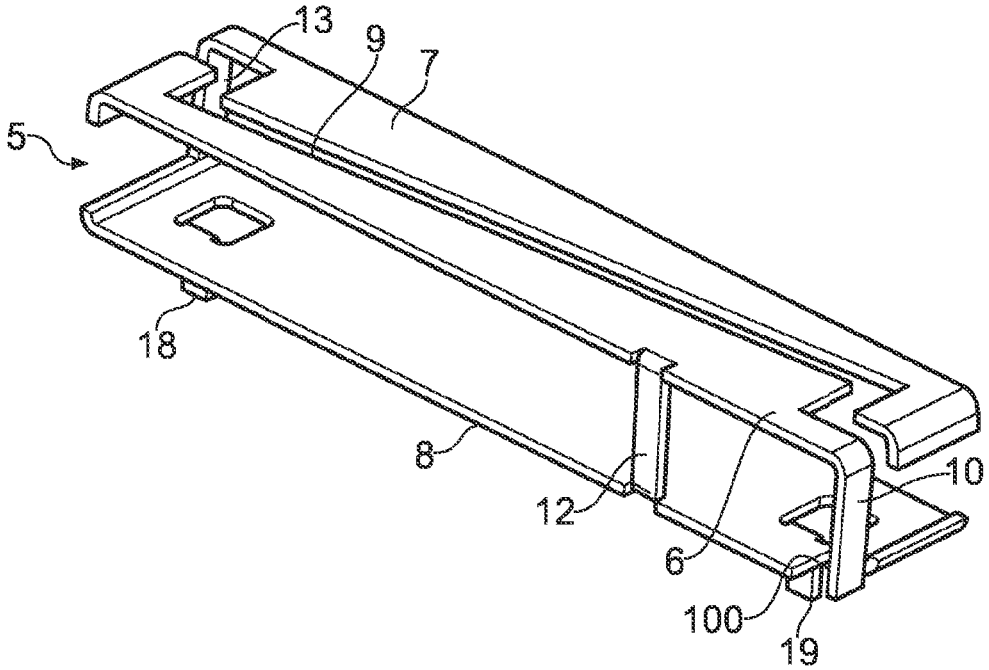
FIG. 3 shows a second embodiment of the present invention.

FIG. 3 shows a second, alternative embodiment which is substantially the same as the first embodiment, except in that the feed connection or pin 10 and the ground connection or pin 12 of the first plate 6 are swapped around. The feed connection or pin 10 extends through the third plate 8 by way of a slot or cut-out 100 formed in the third plate 8.

Figure 4:
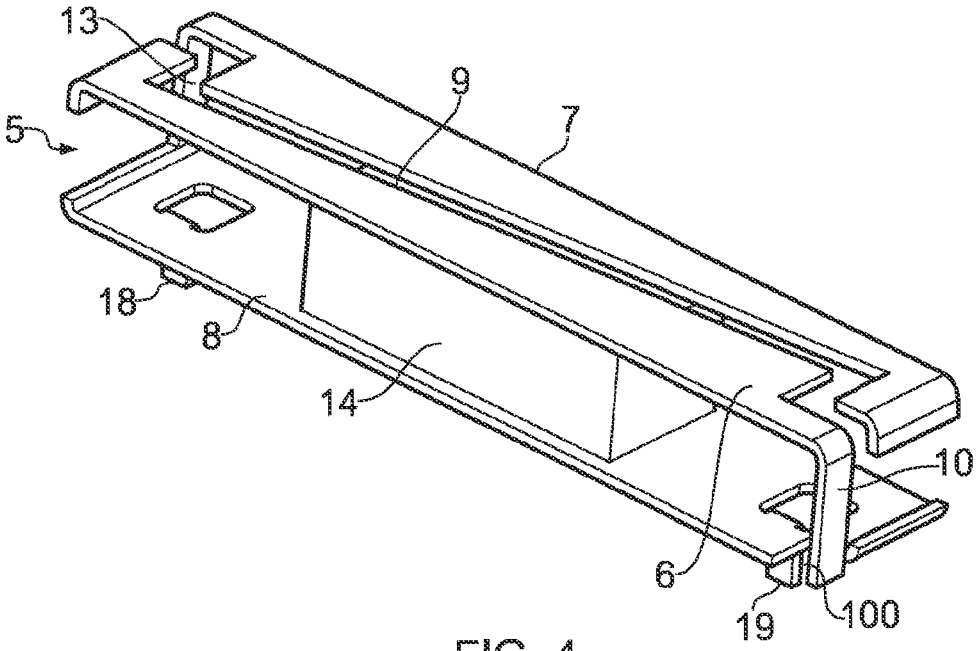
FIG. 4 shows a third embodiment of the present invention.

In a third embodiment, shown in FIG. 4, the first plate 6 is not provided with a ground connection or pin, but instead has only a feed connection or pin 10. In this embodiment, the first plate 6 is not physically connected to the third plate 8, and comprises a separate sheet of metal. In order to provide structural integrity, it is necessary for a non-conductive mechanical support 14 to be provided between the third plate 8 and the first plate 6.

Figure 5:
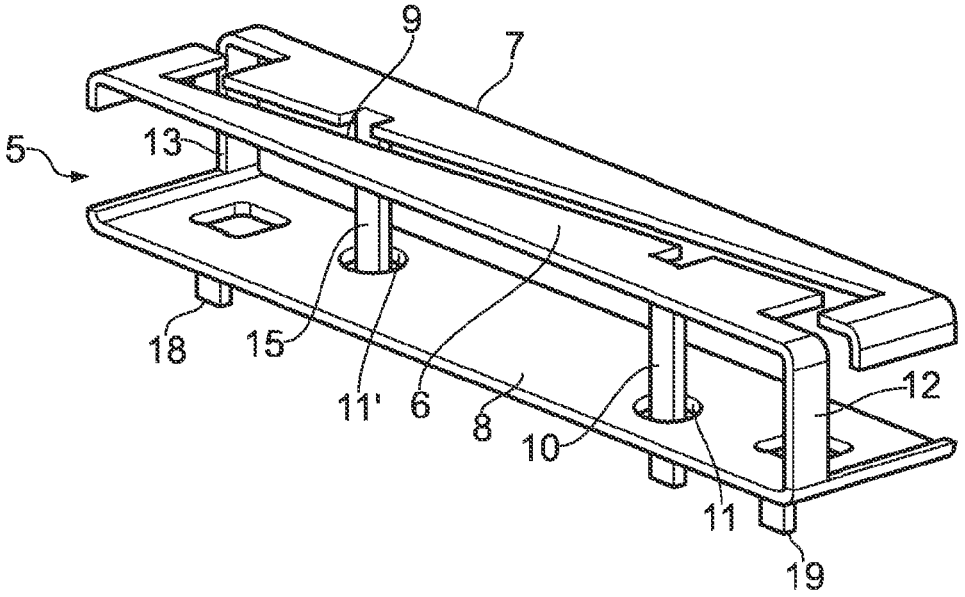
FIG. 5 shows a fourth embodiment of the present invention.

In a fourth embodiment, shown in FIG. 5, both arms (i.e. both the first plate 6 and the second plate 7) are fed and grounded. This arrangement is similar to the arrangement of FIG. 2, with the addition of a feed connection or pin 15 for the second plate 7 and an additional hole 11' in the third plate 8 through which the feed connection or pin 15 may be passed. In this embodiment, the second plate 7 is fed with a signal that is out of phase with a signal that is fed to the first plate 6 so as to form a differential feeding arrangement.

Figure 6A:
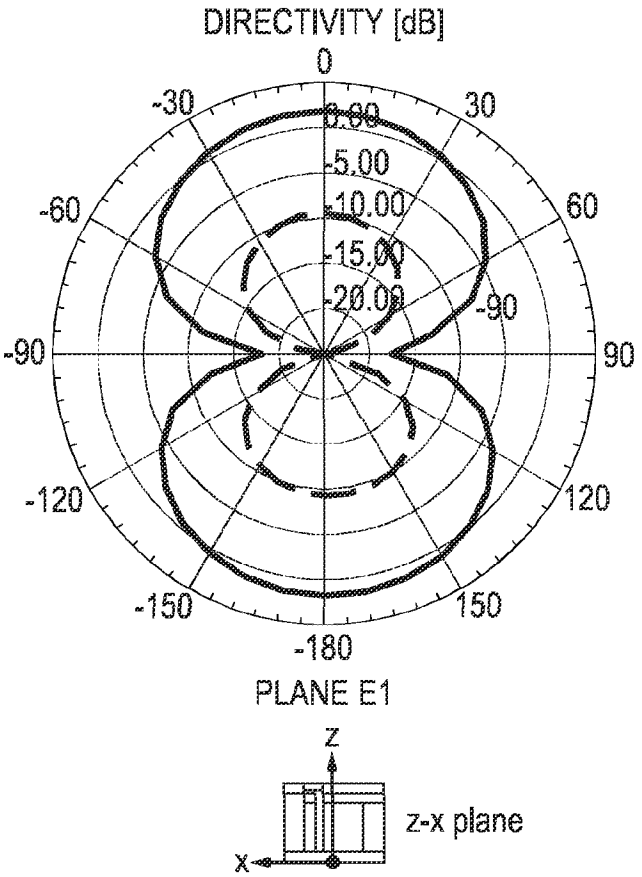
FIGS. 6*a* and 6*b* show the radiation patterns of an antenna of the present invention when used without connection to a groundplane.
Figure 6B:
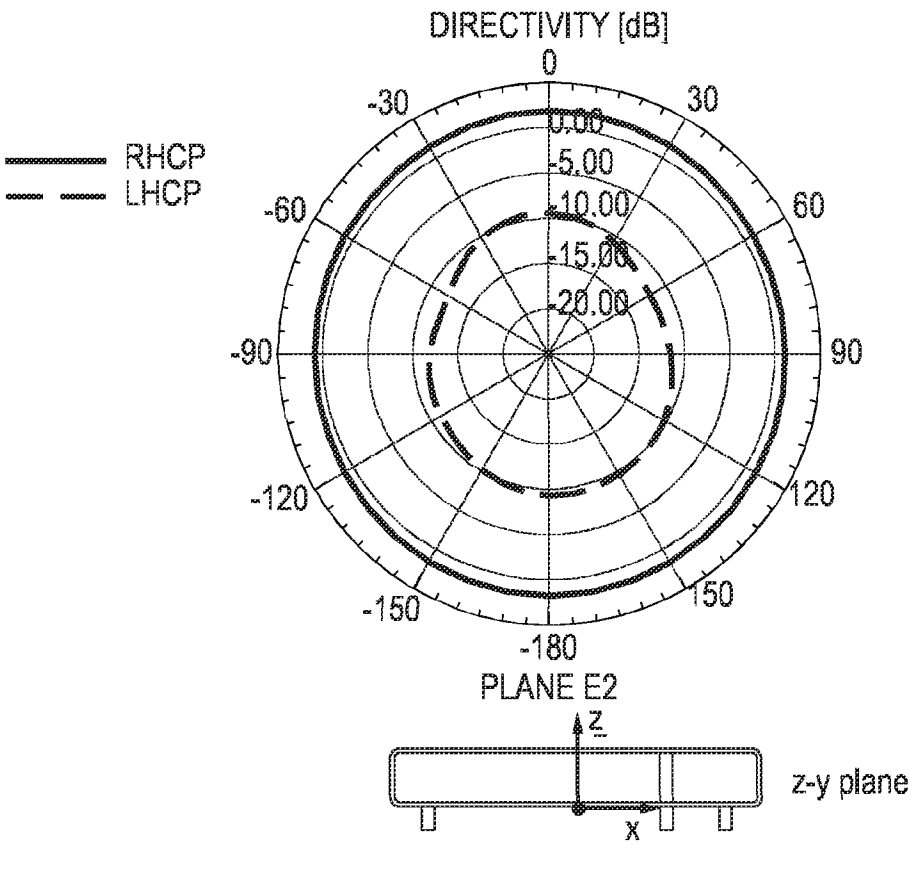

In one exemplary embodiment (FIG. 2) the antenna 5 is used without connection to a groundplane. The radiation patterns are shown in FIGS. 6*a* (z-x plane of the antenna pattern) and 6*b* (y-z plane of the antenna pattern) and they can be seen to be the same as those of a dipole, except that the patterns exhibit strong RHCP. The RHCP response is better than the LHCP response by a factor of 10 dB or more. This is very good for an electrically small device.

Figure 7C:
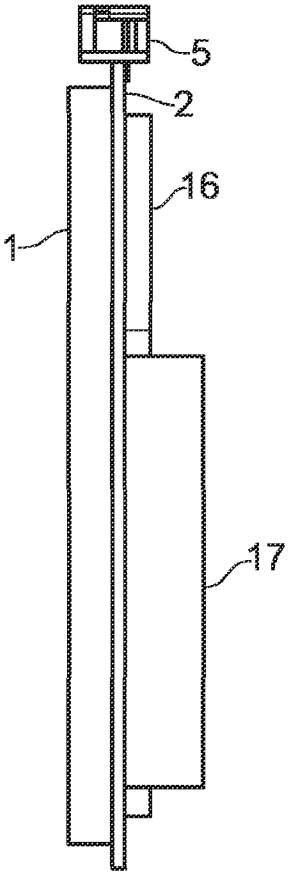
FIGS. 7*a*, 7*b* and 7*c* show an embodiment of the present invention connected to the PCB of a consumer navigation device.
Figure 7B:
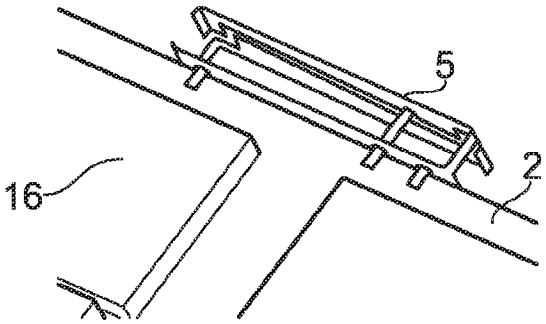
Figure 7A:
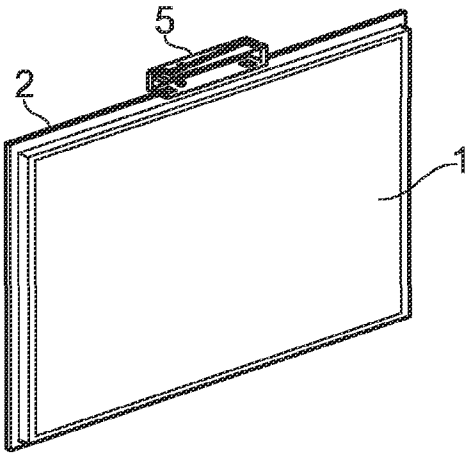

In another exemplary embodiment (FIG. 2) the antenna 5 is connected to the PCB 2 of a consumer navigation device or other GPS-enabled device, as illustrated in FIGS. 7*a*, 7*b* and 7*c*. It can be seen in FIG. 7*b* that the antenna 5 is easily soldered or reflowed onto the edge of the PCB 2. FIG. 7*c* shows that the minimum device thickness is no longer dictated by the antenna 5, but rather by the PCB 2, an LCD screen 1, electronic circuitry 16 and a power supply 17.

Figure 8B:
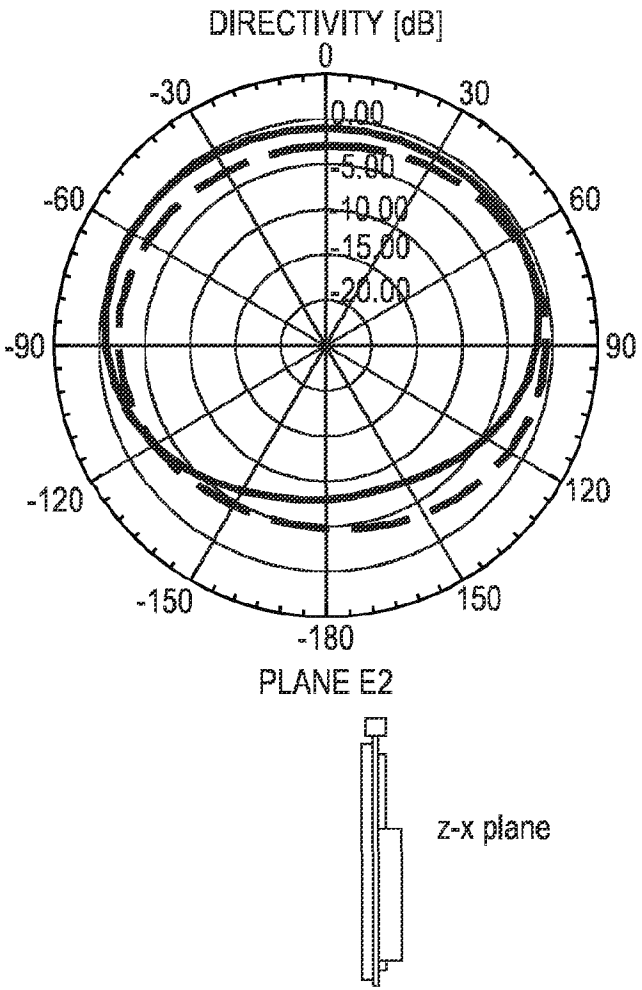
FIGS. 8*a* and 8*b* show the radiation patterns of the antenna of FIGS. 7*a* to 7*c* when connected to the groundplane of the consumer navigation device.
Figure 8A:
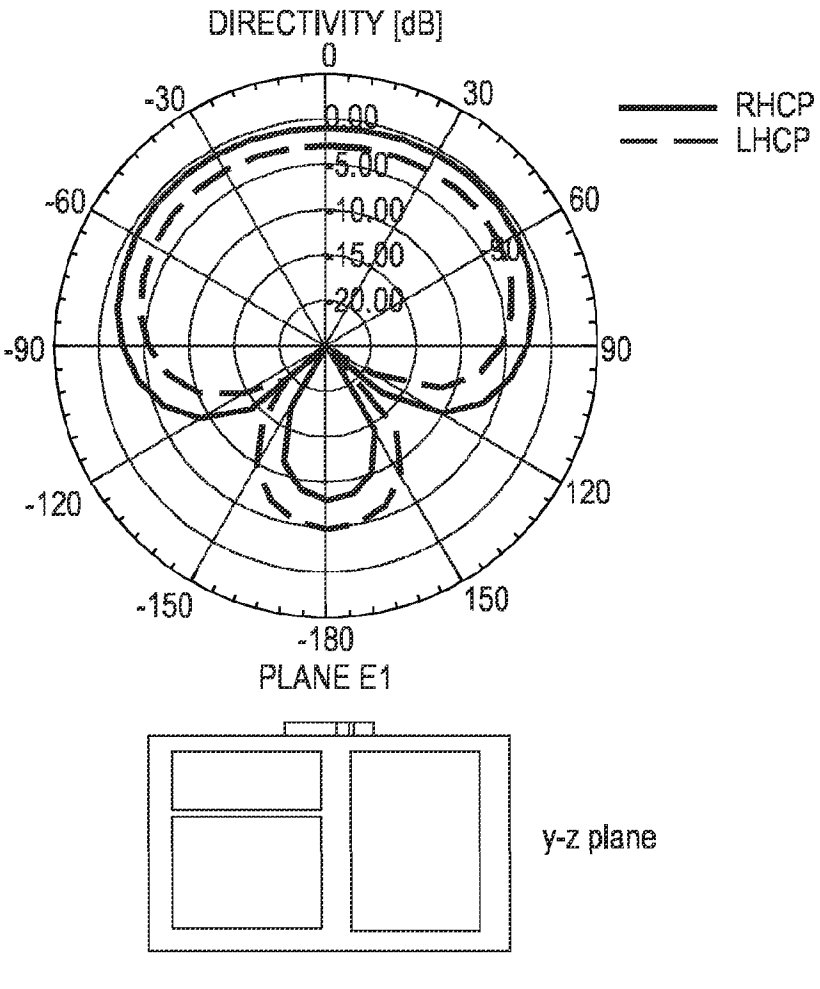

Despite the perturbing influence of the groundplane, the antenna 5 still exhibits a preference for RHCP, as can be seen in FIGS. 8*a* (y-z plane of the antenna pattern) and 8*b* (z-x plane of the antenna pattern). Furthermore, the antenna 5 shows excellent upward radiation characteristics, as required for most navigation applications. In this respect the radiation pattern of the present invention is similar to that of a ceramic patch antenna, but the present invention is much thinner in profile and cheaper to manufacture.

Figure 9:
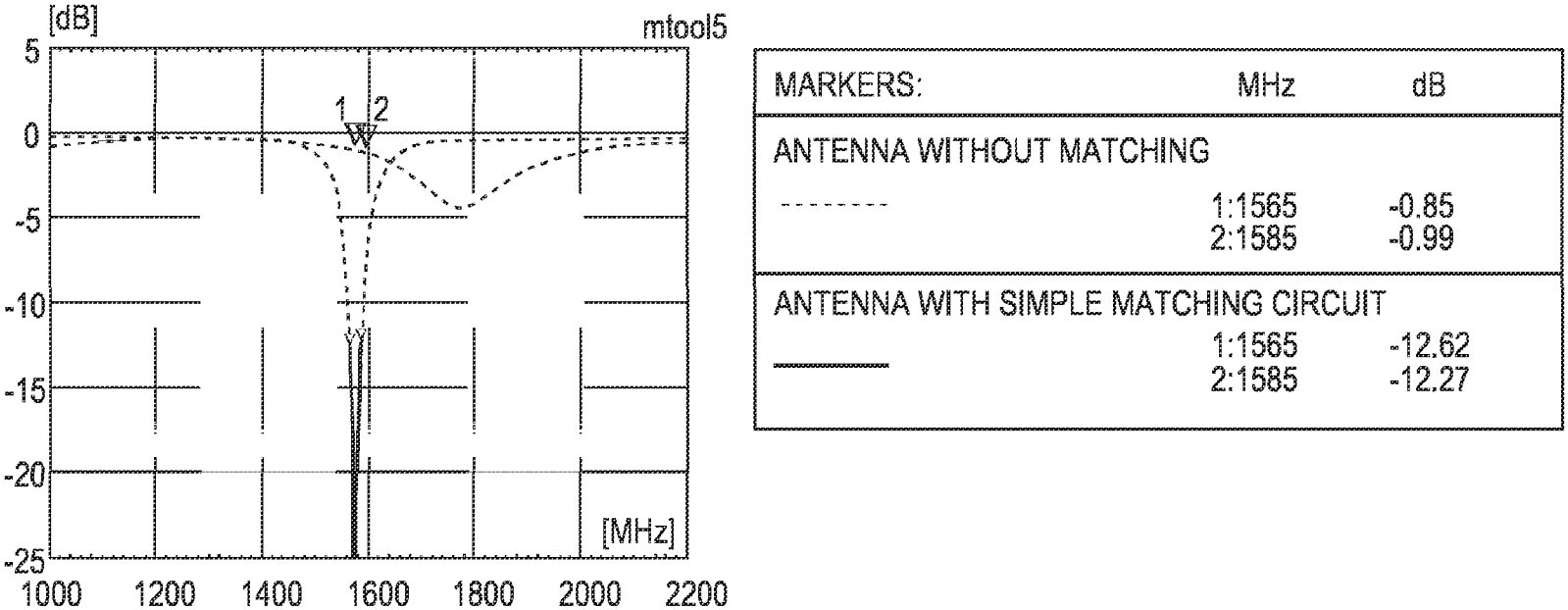
FIG. 9 shows the impedance of an antenna of the present invention across a frequency band of interest both before and after matching.

An important advantage of embodiments of the present invention is that they have a wider impedance bandwidth than the sharp resonance of a ceramic patch antenna. This wider bandwidth makes it much easier to use in different applications. Furthermore, the antenna 5 is easily matched to the 50 ohm impedance typical of many RF systems using a simple LC matching circuit having typically one or two components. In different applications, the resonant frequency of the antenna 5 can therefore be adjusted simply by changing the matching circuit, at least within a reasonable frequency range. This is considered advantageous in the integration and manufacturing process, as the same antenna 5 can be easily re-used in many different devices without any physical or mechanical change. Only the matching circuit needs to be changed. An example of matching the antenna in a typical application is shown in FIG. 9.

Figure 10:
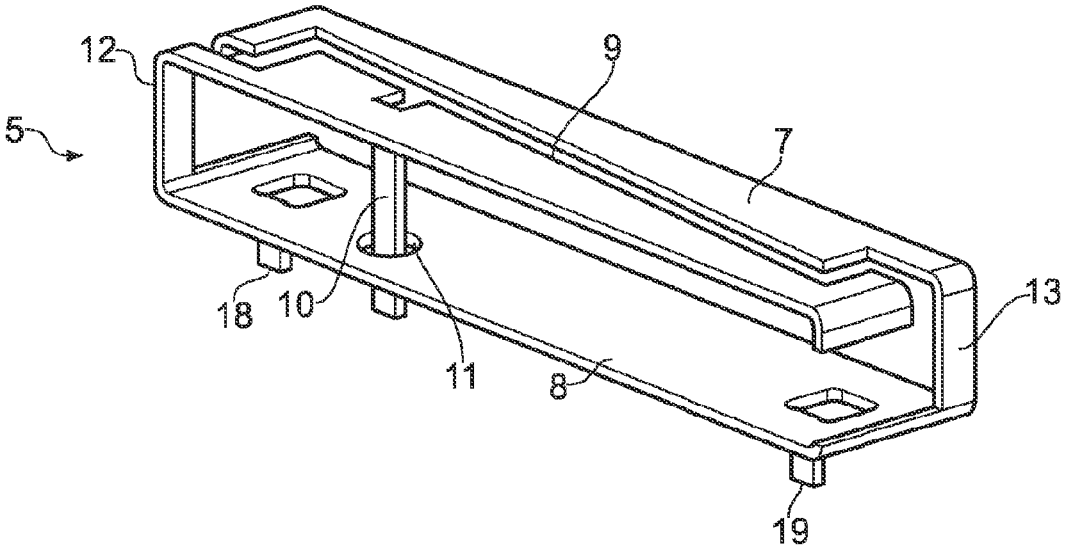
FIG. 10 shows a variation of the embodiment of FIG. 2 configured to generate LHCP.

In the exemplary embodiments shown so far the antenna 5 has been used for GPS applications where RHCP response and an upward radiation pattern response is preferred. However, in other applications, LHCP may be preferred. RHCP and LHCP are easily swapped by symmetry operations. FIG. 10 shows a variation of the embodiment of FIG. 2, using the same labelling of parts, that is configured to generate LHCP. Other radiation patterns may be created by disposing the antenna 5 in different locations on the PCB 2.

Figure 12:
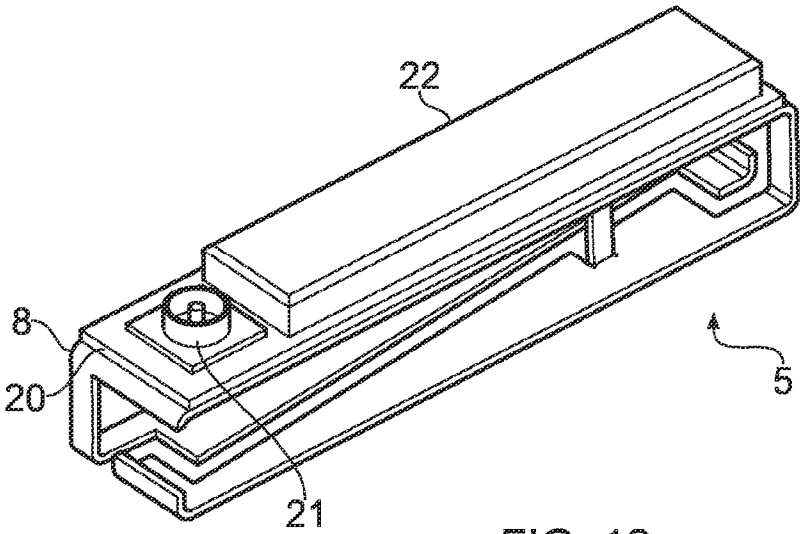
FIGS. 11 and 12 show an embodiment comprising an antenna with an integrated radio circuit.
Figure 11:
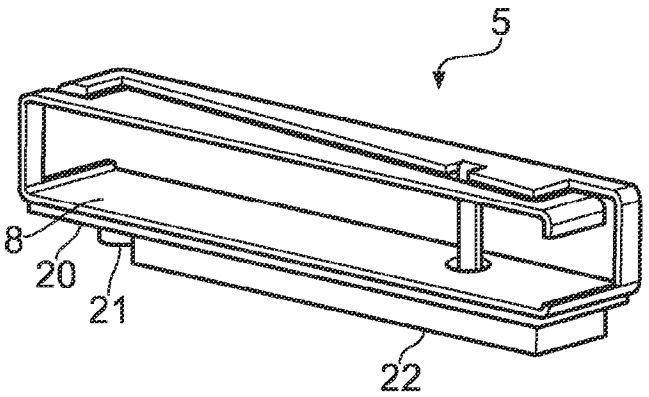

In the exemplary embodiments shown so far the antenna has been described as a stand-alone component separate from the radio. However, as shown in FIGS. 11 and 12, the presence of the bottom ground plate 8 allows the possibility of attaching a small PCB 20 mounted with the components required for a RF front end (Low Noise Amplifier plus a Surface Acoustic Wave filter) or a complete a radio receiver. In this way, an active antenna or complete radio-antenna module is created. The input to the LNA or radio receiver may be connected to the feed 10 of the antenna 5 and the ground of the LNA or radio would be connected to the bottom ground plate 8 of the antenna 5. The output of the radio/LNA is connected to the host PCB using a commercially available connector 21, coaxial cable or via soldering pins. A conductive shielding can 22 is provided to shield the LNA or radio receiver components.

Figure 14:
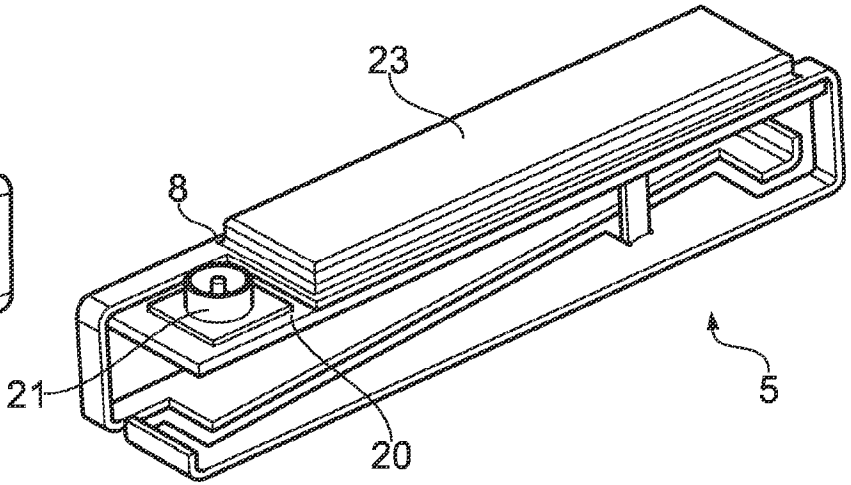
FIGS. 13 and 14 show an embodiment comprising an antenna with an integrated radio circuit and a screening can made from an extension of the ground plate.
Figure 13:
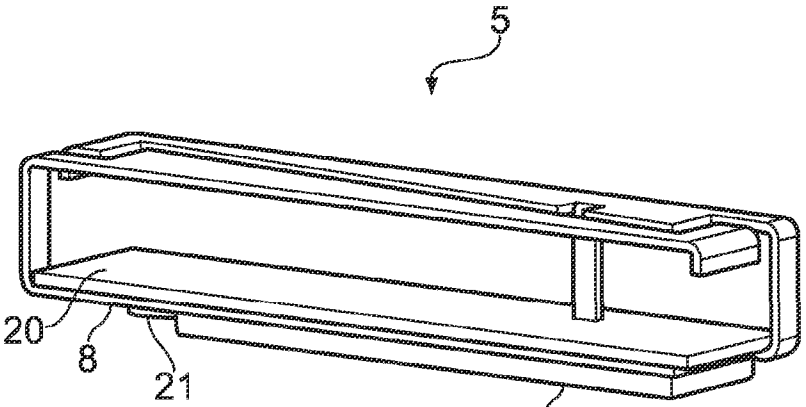

In a further embodiment, shown in FIGS. 13 and 14, the stamping, cutting and bending process used to create the antenna from a sheet of metal is also used to create a screened volume 23 beneath the ground plate suitable for locating the radio. The radio-antenna module is thus created with an integral screening can 23 for the radio.

Figure 15:
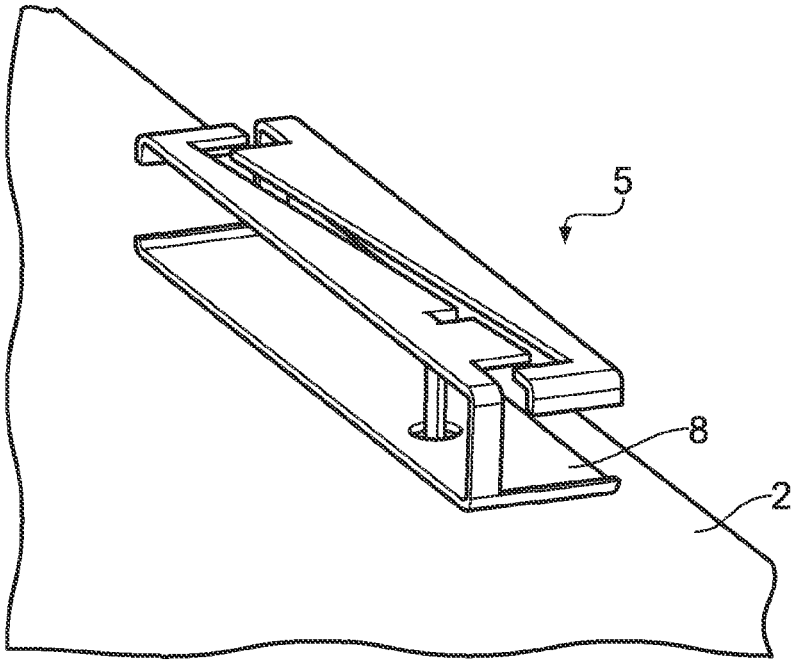
FIG. 15 shows an alternative mounting arrangement on a PCB substrate.

Instead of mounting the antenna device 5 on a top edge of a PCB substrate 2 as shown in, for example, FIGS. 7*a* to 7*c*, it is also possible for the antenna device 5 to be mounted on a flat surface of a PCB substrate 2 as shown in FIG. 15. In this arrangement, there is no requirement for tabs 18, 19, and the bottom ground plate 8 may be soldered directly to a flat surface of the host PCB 2 as shown.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An antenna assembly comprising:

a first conductive plate and a second conductive plate both co-planar in a first plane; and a third conductive plate positioned in a second plane substantially parallel to the first plane, the three conductive plates being assembled to form a parallelepiped antenna configuration that transmits or receives circularly polarized signals, the parallelepiped antenna configuration having a first side in the first plane, a second side in the second plane and four inter-plane sides intersecting the first and second sides, each of the first conductive plate and the second conductive plate having one or more conductive connections to the third conductive plate, at least one of the conductive connections of each of the first conductive plate and the second conductive plate being formed along a different one of the four inter-plane sides of the parallelepiped antenna configuration, each of the four inter-plane sides having no more than one conductive connection formed along the same inter-plane side.

2. The antenna assembly of claim 1 wherein the first conductive plate, the second conductive plate, and the third conductive plate are formed from a continuous piece of metal.

3. The antenna assembly of claim 1 wherein the first conductive plate, the second conductive plate, and the third conductive plate are formed from a flexible printed circuit wrapped around a non-conductive support.

4. The antenna assembly of claim 1 wherein the first conductive plate includes an active antenna arm and a conductive feed connection.

5. The antenna assembly of claim 4 wherein the first conductive plate further includes a conductive grounding connection to the third conductive plate.

6. The antenna assembly of claim 4 wherein the conductive feed connection of the first conductive plate is formed along one of the inter-plane sides of the parallelepiped antenna configuration.

7. The antenna assembly of claim 4 wherein the conductive feed connection of the first conductive plate extends within the interior of the parallelepiped antenna configuration and not along one of the inter-plane sides of the parallelepiped antenna configuration.

8. The antenna assembly of claim 7 wherein the conductive feed connection of the first conductive plate passes extends substantially orthogonally from the first conductive plate through a hole in the third conductive plate.

9. The antenna assembly of claim 1 wherein the second conductive plate includes a passive antenna arm and a conductive grounding connection to the third conductive plate.

10. The antenna assembly of claim 1 wherein the first conductive plate includes an active antenna arm and a conductive feed connection and the second conductive plate includes a passive antenna arm and a conductive grounding connection to the third conductive plate.

11. The antenna assembly of claim 10 wherein the conductive feed connection and the conductive grounding connection are formed along opposing inter-plane sides of the parallelepiped antenna configuration.

12. The antenna assembly of claim 11 wherein the first conductive plate further comprises a conductive grounding connection to the third conductive plate formed along an inter-plane side of the parallelepiped antenna configuration that is adjacent to the opposing inter-plane sides of the parallelepiped antenna configuration.

13. The antenna assembly of claim 1 wherein the first conductive plate includes a first conductive grounding connection to the third conductive plate and the second conductive plate includes a second grounding conductive connection to the third conductive plate.

14. The antenna assembly of claim 13 wherein the first conductive grounding connection and the second conductive grounding connection are formed along opposing inter-plane sides of the parallelepiped antenna configuration.

15. The antenna assembly of claim 14 wherein the first conductive plate further comprises a conductive feed connection formed along an inter-plane side of the parallelepiped antenna configuration that is adjacent to the opposing inter-plane sides of the parallelepiped antenna configuration.

16. The antenna assembly of claim 1 wherein the first conductive plate and the second conductive plate are separated by a slot in the first plane.

17. The antenna assembly of claim 16 wherein an electromagnetic field radiated by the slot and an electromagnetic field radiated by a radio-frequency current circulating around a loop-like path formed by the three conductive plates combine to create radiation having circular polarization emanating from the antenna assembly.

18. The antenna assembly of claim 1 wherein the antenna assembly is configured to generate right handed circular polarization radiation when the first conductive plate is fed and to generate left handed circular polarization radiation when the second conductive plate is fed.

19. The antenna assembly of claim 1 wherein the first conductive plate includes an active antenna arm, a conductive feed connection, and a conductive grounding connection to the third conductive plate, the second conductive plate includes an active antenna arm, a conductive feed connection, and a conductive grounding connection to the third conductive plate, and the first conductive plate is fed with a signal that is out of phase with a signal that is fed to the second conductive plate to form a differential feeding arrangement.

20. A method comprising:

forming an antenna assembly including a first conductive plate and a second conductive plate both co-planar in a first plane and a third conductive plate positioned in a second plane substantially parallel to the first plane, the three conductive plates being assembled to form a parallelepiped antenna configuration that transmits or receives circularly polarized signals, the parallelepiped antenna configuration having a first side in the first plane, a second side in the second plane and four inter-plane sides intersecting the first and second sides, each of the first conductive plate and the second conductive plate having one or more conductive connections to the third conductive plate, at least one of the conductive connections of each of the first conductive plate and the second conductive plane being formed along a different one of the four inter-plane sides of the parallelepiped antenna configuration, each of the four inter-plane sides having no more than one conductive connection formed along the same inter-plane side.

21. A method comprising:

generating radiation having circular polarization from an antenna assembly having a first conductive plate and a second conductive plate both positioned co-planar in a first plane and a third conductive plate positioned in a second plane substantially parallel to the first plane, the three conductive plates being assembled to form a parallelepiped antenna configuration that transmits or receives circularly polarized signals, the parallelepiped antenna configuration having a first side in the first plane, a second side in the second plane and four inter-plane sides intersecting the first and second sides, each of the first conductive plate and the second conductive plate having one or more conductive connections to the third conductive plate, at least one of the conductive connections of the first conductive plate and the second conductive plate being formed along a different one of the four inter-plane sides of the parallelepiped antenna configuration, each of the four inter-plane sides having no more than one conductive connection formed along the same inter-plane side.

22. The method of claim 21 wherein the circular polarization radiation is generated by a combination of an electromagnetic field radiated by a slot separating the first conductive plate and second conductive plate in the first plane and an electromagnetic field radiated by a radio-frequency current circulating around a loop-like path formed by the three conductive plates.

* * * * *